US007341294B2

(12) United States Patent
Olmstead

(10) Patent No.: US 7,341,294 B2
(45) Date of Patent: Mar. 11, 2008

(54) TENNIS BALL RETRIEVAL CART AND PRACTICE HOPPER

(76) Inventor: Thomas Wilson Olmstead, 27912 Via Janeiro, Laguna Niguel, CA (US) 92677

( * ) Notice: Subject to any disclaimer, the term of this patent is extended or adjusted under 35 U.S.C. 154(b) by 51 days.

(21) Appl. No.: 10/966,947

(22) Filed: Oct. 15, 2004

(65) Prior Publication Data

US 2006/0082171 A1 Apr. 20, 2006

(51) Int. Cl.
*A63B 47/02* (2006.01)

(52) U.S. Cl. ..... 294/19.2; 414/440

(58) Field of Classification Search ..... 294/19.2; 414/434, 440; 56/328.1
See application file for complete search history.

(56) References Cited

U.S. PATENT DOCUMENTS

| | | | | | |
|---|---|---|---|---|---|
| 2,729,046 | A | * | 1/1956 | Patterson | 56/328.1 |
| 3,485,398 | A | * | 12/1969 | Offner | 414/440 |
| 3,593,868 | A | | 7/1971 | Folz | |
| 4,221,524 | A | * | 9/1980 | Morris | 414/439 |
| 4,252,490 | A | | 2/1981 | Keller | |
| 4,721,428 | A | | 1/1988 | Rohrer et al. | |
| 4,735,544 | A | * | 4/1988 | Stotts | 414/440 |
| 4,844,527 | A | | 7/1989 | Ray | |
| 5,147,100 | A | | 9/1992 | Frankel | |
| 5,301,991 | A | | 4/1994 | Chen et al. | |
| 5,368,351 | A | | 11/1994 | Cuti | |
| 5,860,658 | A | | 1/1999 | Callahan | |
| 6,340,188 | B1 | * | 1/2002 | Cuti | 294/19.2 |
| 6,354,643 | B1 | | 3/2002 | Podejko | |
| 6,513,845 | B2 | | 2/2003 | Campomane | |

FOREIGN PATENT DOCUMENTS

| | | | | |
|---|---|---|---|---|
| CH | 662058 | * | 9/1987 | |
| FR | 2574670 | * | 6/1986 | 294/19.2 |
| WO | WO 2006/001678 | * | 1/2006 | |

* cited by examiner

*Primary Examiner*—Saul Rodriguez
*Assistant Examiner*—Paul T Chin
(74) *Attorney, Agent, or Firm*—Michael D. Eisenberg

(57) ABSTRACT

A ball pickup hopper on supporting wheels has a bottom panel contoured with channels extending from a front of the hopper to the supporting wheels. Extending forward of the hopper are opposing left and a right herding rails directing balls in front of the apparatus into the channels as the apparatus is moved over a ground surface. The supporting wheels are positioned and adapted for receiving balls moving through the channels, compressively rotating and lifting the balls between the supporting wheels and the hopper, and expelling the balls into the hopper through openings. A top cover is fitted to enclose the hopper and to alternately act as a base for supporting the hopper at an appropriate height for use in ball practice.

10 Claims, 4 Drawing Sheets

TENNIS BALL RETRIEVAL CART AND PRACTICE HOPPER

RELATED APPLICATIONS

None

BACKGROUND OF THE INVENTION

1. Incorporation by Reference

Applicant hereby incorporates herein by reference, the U.S. patents and U.S. patent applications, if any, referred to in the Description of Related Art section of this application as filed.

2. Field of the Invention

This invention relates generally to ball pick-up and retrieval machines and systems, and more particularly to a tennis ball retrieval cart that doubles as a ball hopper for practice.

3. Description of Related Art

The following art defines the present state of this field and each disclosure is hereby incorporated herein by reference:

Folz, U.S. Pat. No. 3,593,868, describes an apparatus for retrieving tennis balls which may be widely scattered on a court or field which comprises a brush element journaled for rotation in a direction whereby the balls are picked up and swept into a receiving chamber as the apparatus is rolled or moved over the field. An arcuate ramp is provided for cooperation with the brush for assuring that the balls will be efficiently picked dup and directed toward the receiving chamber, and a deflector plate is provided for moving the balls directly into the receiving chamber in a manner substantially precluding accidental loss of the balls therefrom. In addition, oppositely disposed retriever arm members are provided for dislodging balls from a position adjacent a wall, fence, or the like, and for directing the balls thus dislodged into the path of the brush for sweeping thereof into the storage or receiving chamber.

Keller, U.S. Pat. No. 4,252,490, describes a ball retrieving and storage device for gathering balls lying upon a court floor or other flat surface and including a wheeled box-like collector having a bar extending across the front of the collector, the bar having a ball engaging surface which is normally carried above the floor at a height slightly less than the diameter of the balls to be collected so that when the device is moved over the floor and the bar contacts a ball, the bar is caused to ride across the top of the ball and trap it within the collector.

Rohrer et al, U.S. Pat. No. 4,721,428, describes a tennis ball retrieving apparatus comprising a wheeled vehicle having a front end and a rear end. The vehicle has a ball storage container disposed at a level enabling ready removal of balls therefrom by a person next to the vehicle while the person is in a standing position. There are a pair of horizontal ball gathering arms at the front of the vehicle arranged in V formation to provide an apex portion to which gathered balls are fed. A pair of the wheels of the wheeled vehicle are in traction contact with the surface on which the vehicle is supported to be driven thereby in rotary fashion as the vehicle is moved over the supporting surface. The wheels are supported with the lower portions of the tires spaced from one another less than the diameter of a tennis ball so as to grip the same when a ball is fed thereto. A chute extends from the area just rearwardly of the lower portions of the tires upwardly to the storage container. The feed wheels are operable by successively feeding balls into the chute to cause previously fed balls by nudging contact to be fed upwardly to deposit the balls into the storage container.

Ray, U.S. Pat. No. 4,844,527, describes a multipurpose ball collector, ball storage and ball dispenser using a wheel driven rotating shaft and fixed projections to positively collect balls, a wire cage to store balls and a folding handle with a folding cage door to conveniently allow withdrawing of the balls during practice. The folding handles are pivoted and attach to each other during collection to provide structural integrity. For dispensing, the handles and attached to the cage to form a structure which lifts the cage to within easy reach for the practicing player. Collection arms can also be provided to assist in ball collection or carrying the cage to a storage location.

Frankel, U.S. Pat. No. 5,147,100, describes a ball retrieval device that includes a main body and a ball collection basket for storing retrieved balls. The basket is shaped substantially as a slotted box. Only a single basket opening, located in a forward peripheral portion of the basket, has a width greater than the diameter of a ball. The collection basket is removably attached to the main body using a pair of upward-turned hooked bracket portions that extend through mesh openings in the basket and allow the basket to remain substantially horizontal when the basket is attached to or removed from the main body. Arms which extend from the main body are provided with an arrangement of resilient fingers, strips, brushes or lips that form a channel in which balls are held when they are adjacent to the arms. These fingers, etc., channel balls along the arms towards a conveyor mechanism located within the main body as the ball retriever is pushed forward.

Chen et al, U.S. Pat. No. 5,301,991 describes a ball retrieving and storage cart that generally comprises a wheeled carriage that rollingly supports a basket in a ball retrieving position. In an exemplary embodiment, the basket has a front end and a rear end and includes a bottom wall having two side members oriented front to rear and having a normal position spaced apart less than the ball diameter and defining a slotted aperture for entrance of a ball into the basket. In the ball retrieval position, at least one of the side members is a slanted member having a front end higher from the ground than a ball radius and a rear end lower to the ground than the ball radius. At least one of the side members is a deflectable member and is biased to the normal position but is sideways deflectable such that a ball on the ground entering the aperture sideways deflects the deflectable member sufficiently for the ball to pass into the basket. The wheels may define a rolling plane. The carriage includes a vertical frame member terminating in a push handle and the vertical frame member includes brackets for attaching a moveable basket at a serving position higher that is than the ball retrieving position.

Cuti, U.S. Pat. No. 5,368,351, describes a tennis ball retriever and multi-purpose tennis ball hopper and caddy that holds all of the tennis equipment used during play and practice. The retriever utilizes a container portion incorporating a bottom of transverse rods which are slightly resilient and incorporates a telescoping handle structure used in ball retrieval and as a support stand for the ball container portion. The hopper has side walls that open for easy access to the container.

Callahan, U.S. Pat. No. 5,860,658, describes an object storage receptacle having two articulating arm members movably attached to opposite sides of a receptacle member at a point at or above the center of gravity of said receptacle member. The articulating arm members are attached to the receptacle member such that in a first position the arm members form a handle by which the storage receptacle may be carried, in a second position the arm members form a stand sufficiently stable to support the storage receptacle in a free-standing manner, and in a third position the arm members together may be disposed laterally relative to the storage receptacle. The arm members may be capable of free movement throughout a continuous circle about the receptacle and/or capable of telescoping into a first position where the arm members are fully extended for use and in a second position where the arm members are fully retracted for storage. Wheels may be attached to at least one arm member to enable the user to roll the device to a different location during use without lifting and carrying the entire device.

Podejko, U.S. Pat. No. 6,354,643, describes a tennis ball holder and retriever that is easily movable about the court with four swivel caster assemblies at its corners. The holder and retriever include a wireform basket-like structure with a bottom wall designed to pick up tennis balls when pushed down over the balls. The swivel caster assemblies have small diameter wheels and are mounted to the corners of the basket-like structure with downwardly spring-biased telescopic tubular assemblies that position the basket above the balls for rolling movement about the court yet permit the basket-like structure to be depressed to its ball pick-up position.

Campomane, U.S. Pat. No. 6,513,845, describes an apparatus for retrieving tennis balls from a playing surface of a tennis court and for storing the tennis balls either for preventing the same from being removed by non authorized persons or for subsequent removal for playing purposes, either by taking the balls directly from the apparatus of by transferring the balls to another receptacle, the apparatus including a closed container having an open front wall, a ramp at the open wall for receiving the balls and directing the same into the container through the open wall, and a handle and wheels for carrying the container on the playing surface.

Our prior art search with abstracts described above teaches several ball pickup devices including those that have forward extending arms and wheels to grip balls and move them into a hopper. However, the prior art fails to teach the improved arms claimed herein, and particularly fails to teach the use of grooves or passageways for directing the balls to one side of the hopper where the wheels compress the balls between the wheel and the hopper and rolls the ball into entryways into the hopper. The prior art also fails to teach the instant raised support of the hopper using its cover. The present invention fulfills these needs and provides further related advantages as described in the following summary.

SUMMARY OF THE INVENTION

The present invention teaches certain benefits in construction and use which give rise to the objectives described below.

In the best mode embodiments of the present invention, a ball pickup hopper on supporting wheels has a bottom panel contoured with channels extending from a front of the hopper to the supporting wheels. Extending forward of the hopper are opposing left and a right herding rails directing balls in front of the apparatus into the channels as the apparatus is moved over a ground surface. The supporting wheels are positioned and adapted for receiving balls moving through the channels, compressively rotating and lifting the balls between the supporting wheels and the hopper, and expelling the balls into the hopper through openings. A top cover is fitted to enclose the hopper and to alternately act as a base for supporting the hopper at an appropriate height for use in ball practice.

A primary objective of the present invention is to provide an apparatus and method of use of such apparatus that yields advantages not taught by the prior art.

Another objective of the invention is provide an improved tennis ball pickup apparatus enabled for using the rotation of its supporting wheels to lift the balls into a hopper.

A further objective of the invention is provide such an apparatus that is able to be turned and steered without loosing balls that are within its forwardly projecting arms.

A still further objective of the invention is to provide such an apparatus where a hopper cover is able to be used as a base for supporting the hopper at a selected height.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

Figure 1:
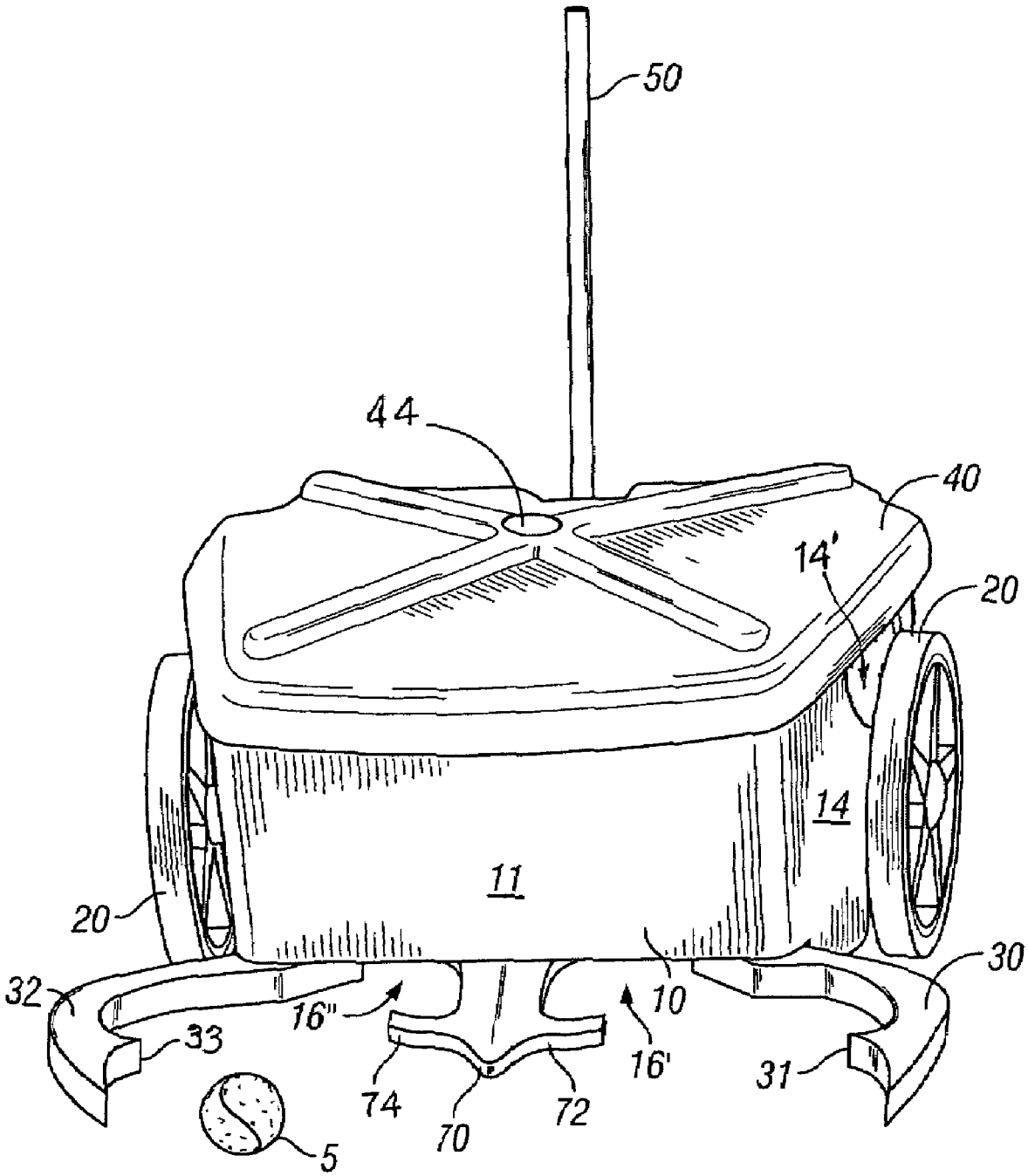
FIG. 1 is a perspective frontal view of one embodiment of the invention as configured for picking up tennis balls.

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

In a preferred embodiment of the present invention a ball pickup apparatus is used for retrieving tennis balls 5 (FIG. 1) from a tennis court, but is also useful for picking up balls in other sports as well, e.g., golf, base ball, jai-ajal, ping-pong, and so on. The apparatus comprises a hopper 10 which may hold at least 50 tennis balls 5 and provides front 11, rear 12, left side 14, right side 15, and bottom 16 panels as shown in the figures, and which preferably form an integrally molded unitary part. Each of the side panels 14 and 15 rotationally engage an associated first supporting wheel 20. The bottom panel 16 is contoured with two channels 16' and 16", each of which extends from the front panel 11, along the bottom panel 16, to one of the side panels 14 or 15 and opens outwardly adjacent to one of the associated supporting wheels 20. In this specification, the usage of the word "wheel" is meant to refer to the supporting wheels 20, as shown in the figures, upon which the apparatus rolls, and also any ancillary portions that rotate with such wheels 20 and that may be used for raising balls 5 into the hopper 10.

Figure 2:
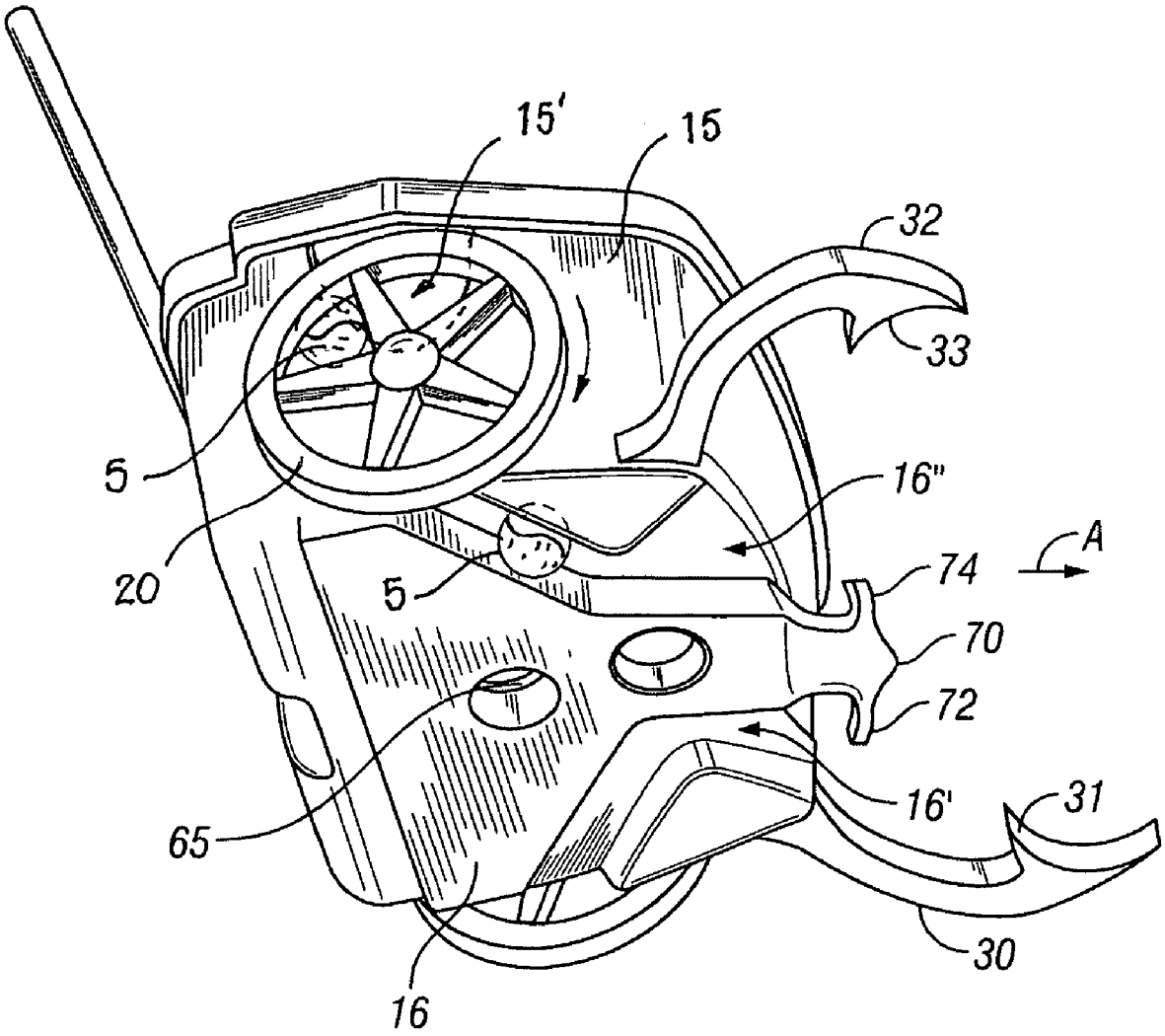
FIG. 2 is a perspective bottom view thereof.
Figure 3:
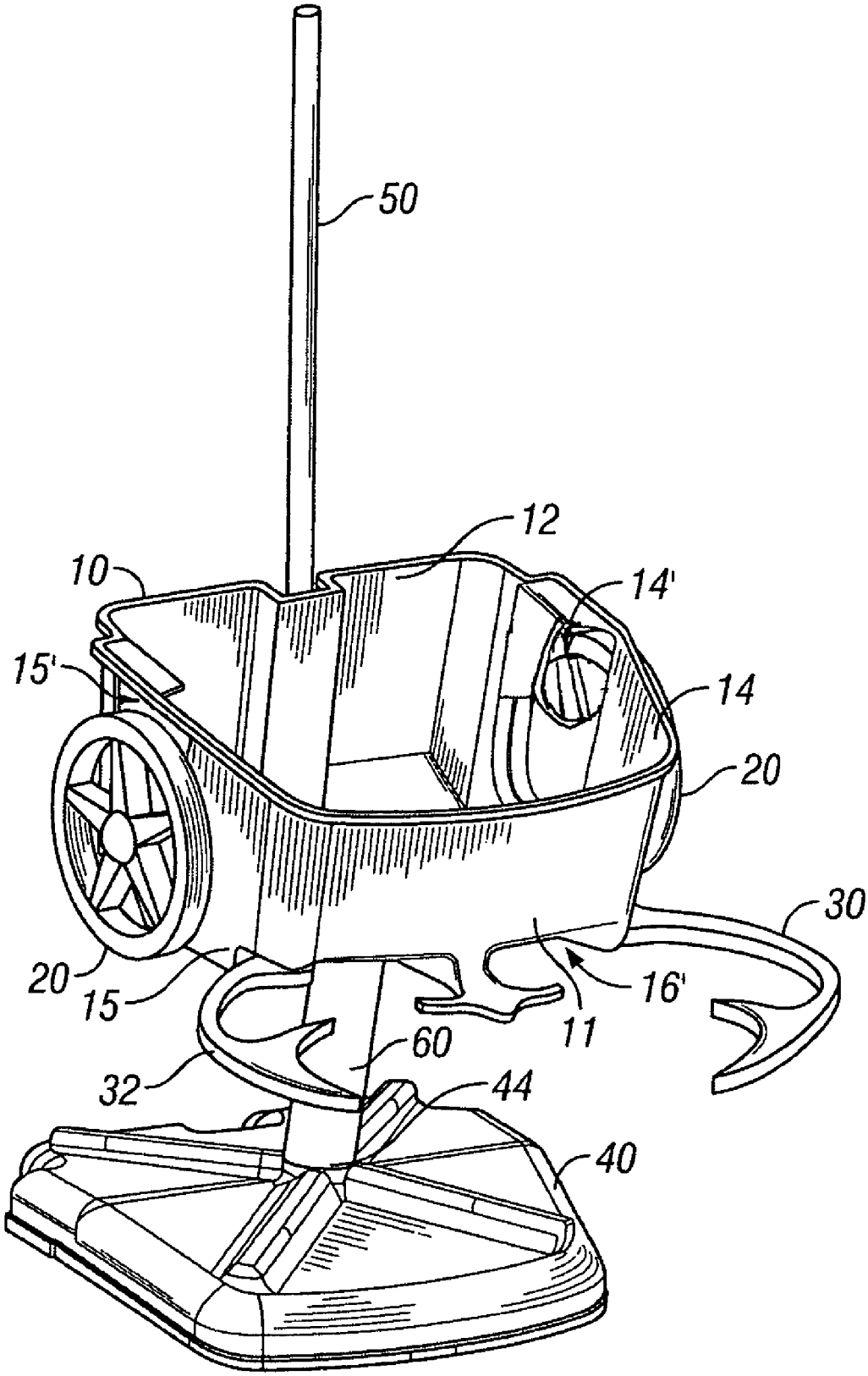
FIG. 3 is a perspective view thereof as seen from above and as configured for use as a hopper for practice.
Figure 4:
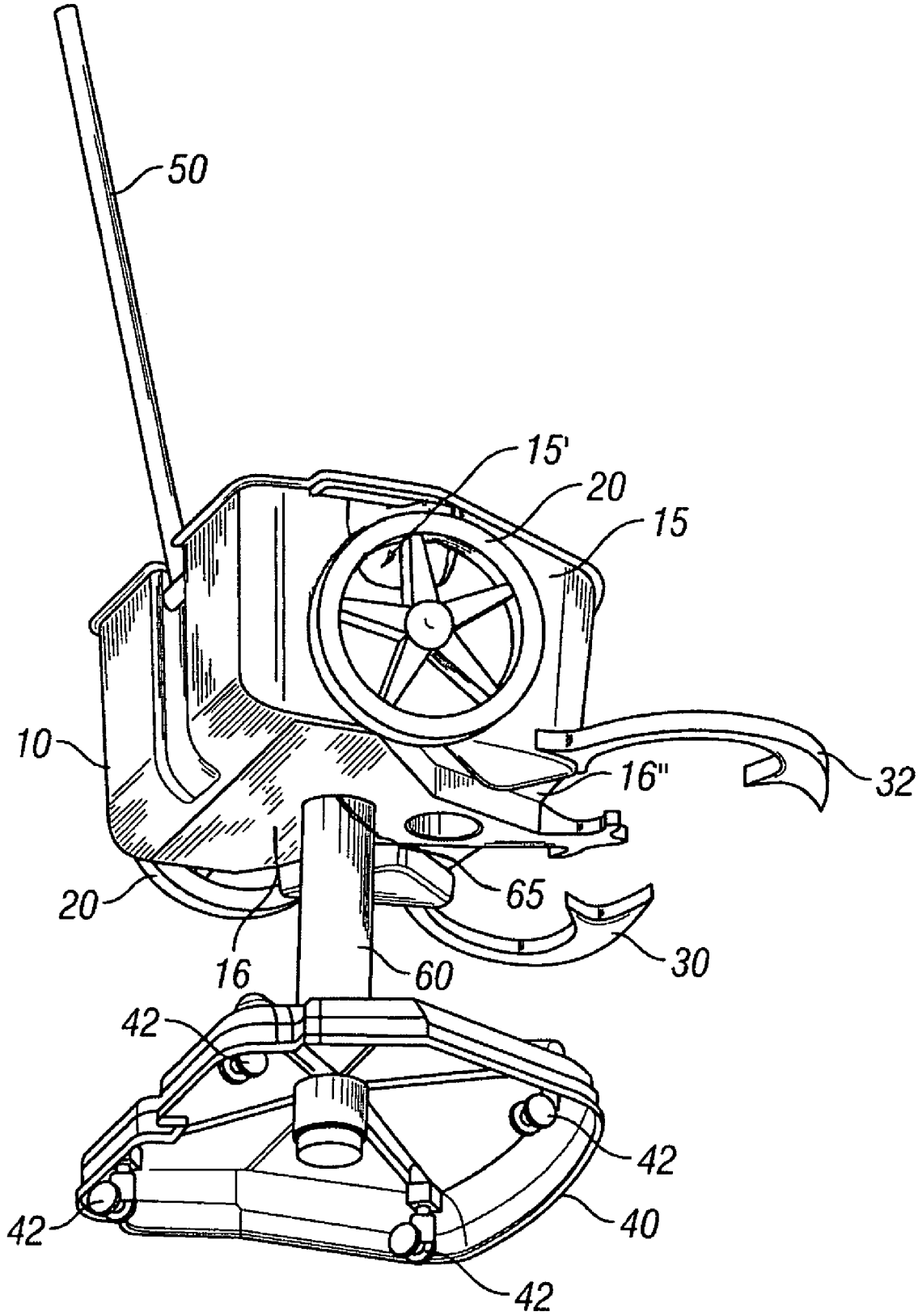
FIG. 4 is a perspective view thereof as seen from below.

A pair of opposing left 30 and a right 32 herding rails extend forward as extensions of the sides of the hopper 10 and are proximally engaged with it, as best seen in FIGS. 1 and 2. As shown in FIGS. 3 and 4 these herding rails 30 and 32 may be simple curved arms extending in parallel with the ground surface at an elevation sufficient to capture balls lying thereon. These herding rails 30 and 32, in one preferred embodiment, provide distally positioned retro-guides 31 and 33 respectively, which extend generally rearwardly and inwardly (toward the center) for securing balls 5 positioned between the herding rails 30 and 32 when the apparatus is moved over the ground surface and steered to one side, i.e., it prevents balls 5 from rolling out of the space between the two rails 30 and 32. These rails 30, 32 direct the balls 5, which are in front of the apparatus, into the channels 16' and 16" as the apparatus is moved over the ground surface, e.g., the surface of a tennis court in the direction shown by arrow A in FIG. 2.

A top cover 40, preferably of plastic molded construction, is fitted to enclose the hopper 10. The top cover 40 provides second supporting wheels 42, as shown in FIG. 4, for moving the cover 40 over the ground surface when the cover 40 is placed in contact with the ground surface. Second wheels 42 are preferably caster type wheels so that the cover 40 may be moved in any selected direction by merely pushing it. A support strut 60, preferably a tube, is engaged proximally with a first support strut receiver 44 in the top cover 40 so that the strut 60 may be positioned vertically when the cover 40 is resting on the ground surface. The bottom panel 16 of the hopper 10 provides a second support strut receiver 65 which, when it is engaged distally with the support strut 60, positions the hopper 10 at a preferred elevation above the ground surface, i.e., a convenient level for a tennis player to reach its contained balls 5 for tennis practice.

The side panels 14 and 15, and the first supporting wheels 20 are positioned and adapted by their contour for receiving the balls 5 which exit the channels 16' and 16" by applying a compressive rotating and lifting force so that the balls 5 are captured between the first supporting wheels 20 and the side panels 14 and 15, and roll with the wheels 20 until they are expelled into the hopper 10 through openings 14' and 15' in the side panels 14 and 15 respectively. FIG. 2 shows this principal of moving balls 5 through channel 16' (one ball 5 is shown in this channel), and then rotating a ball 5 with supporting wheel 20 (one ball 5 is shown compressed between side wall 15 and wheel 20) until the ball 5 is released into opening 15'. Clearly, as described above, when the apparatus is used to collect many balls 5, the forward motion of the apparatus causes the balls 5 to move through channels 16' and 16" and to be captured by wheels 20, one after the next, and delivered into openings 14' and 15'. The adaptation of side panels 14 and 15 with respect to wheels 20 to enable a ball 5 of a specific diameter to be wedged between a side panel 14 or 15, and a wheel 20 is considered to be within the ability of a routine engineer having skill in the art, as this is merely a matter of establishing a space between panel and wheel that accommodates the ball with slight compression, and providing a niche for the ball, as between the spokes of the wheel 20 so that the ball 5 is unable to escape the wheel as the wheel 20 rotates.

The apparatus further preferably provides a push-handle 50 which is mounted in a removable manner in the rear panel and which preferably extends upwardly and rearwardly from it.

In one embodiment of the present invention, the apparatus further preferably provides a herding extension 70 which is centrally mounted on, and extends forward of the front panel 11, as shown in FIGS. 1 and 2. The herding extension 70 preferably provides left 72 and right 74 arm extensions positioned for securing balls 5 which are adjacent to or near the front panel 11 when the apparatus is moved over the ground surface while steering to one side. Thus the arm extensions 72 and 74 are able to steer the balls 5 into the corresponding groove 16' or 16" as the apparatus turns toward the same corresponding side.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A ball pickup apparatus comprising:

a hopper providing front, rear, left side right side, and bottom panels;

the left and right side panels each engaging a supporting wheel;

the bottom panel contoured with two channels, each of the channels extending from the front panel, along the bottom panel to one of the side panels, opening outwardly adjacent one of the supporting wheels;

opposing left and right herding rails connected to the hopper and extending forward of the hopper, the herding rails positioned for directing balls lying on a ground surface in front of the apparatus into contact with the front panel, the channels positioned and adapted for receiving the balls as the apparatus is moved over the ground surface toward the balls, the forward motion forcing the balls through the channels so as to exit adjacent the supporting wheels;

the supporting wheels positioned for compressing and rotating the balls upwardly against the side panels;

the side panels providing openings positioned for receiving the balls as they move with the supporting wheels past the openings so that the balls move into the hopper.

2. The apparatus of claim 1 wherein each of the channels is of such width as to constrain the balls to move in single-file order therethrough thereby avoiding jamming of the balls in the channels.

3. The apparatus of claim 1 further comprising a herding extension centrally mounted on and extending forward of the front panel.

4. The apparatus of claim 3 wherein the herding extension further provides left and right arm extensions positioned for securing balls adjacent to the front panel when the apparatus is moved over the ground surface and steered to one side.

5. The apparatus of claim 1 wherein the hopper is of such size as to hold at least 50 tennis balls.

6. The apparatus of claim 1 wherein the front, rear, left side, right side, and bottom panels are integrally molded.

7. The apparatus of claim 1 wherein the left and right opposing herding rails provide retro-guides positioned distally on the herding rails and extending generally rearwardly for securing balls positioned between the herding rails when the apparatus is moved over the ground surface and steered to one side.

8. The apparatus of claim 1 wherein a top cover provides second supporting wheels positioned and configured for moving the cover over the ground surface when the top cover is placed thereon.

9. The apparatus of claim 1 further comprising a support strut engaged proximally with a first support strut receiver in the top cover thereby vertically positioning the support strut, the bottom panel of the hopper providing a second support strut receiver engaged with the support strut distally, thereby positioning the hopper at a preferred elevation above the ground surface.

10. A ball pickup apparatus comprising: a hopper supported on a wheel, the wheel rotationally mounted on the hopper; a bottom panel of the hopper contoured so as to form a channel extending from a front of the hopper to the wheel at one side of the hopper and for receiving balls in front of the apparatus so as to enter and move through the channel as the apparatus is moved over a ground surface toward the balls; the supporting wheel positioned and adapted for receiving and compressing the balls against the hopper so as to roll the balls between the wheel and the hopper thereby lifting the balls into the hopper through an opening therein; a top cover having second supporting wheels for rolling the cover over the ground surface when the cover is placed thereon; and a support strut engaged proximally with a first support strut receiver in the top cover thereby vertically positioning the support strut when the cover is rested on the second support wheels, the bottom panel of the hopper providing a second support strut receiver engaged with the support strut distally, thereby positioning the hopper at a preferred elevation above the ground surface.

* * * * *